United States Patent [19]

Baum

[11] 4,002,467

[45] Jan. 11, 1977

[54] METHOD FOR RECOVERING REACTION GASES FROM STEEL CONVERTERS WHICH ARE BOTTOM BLOWN WITH OXYGEN AND COOLED WITH HYDROCARBONS

[75] Inventor: Kurt Baum, Essen, Germany

[73] Assignee: Verfahrenstechnik Dr.-Ing. Kurt Baum, Essen, Germany

[22] Filed: Oct. 15, 1974

[21] Appl. No.: 514,364

[30] Foreign Application Priority Data

Jan. 30, 1974 Germany ..... 2404288

[52] U.S. Cl. ..... 75/60; 75/59

[51] Int. Cl.[2] ..... C21C 5/38

[58] Field of Search ..... 75/59, 60

[56] References Cited

UNITED STATES PATENTS

| | | | |
|---|---|---|---|
| 3,154,406 | 10/1964 | Allard | 75/60 |
| 3,706,549 | 12/1972 | Knuppel | 75/60 |
| 3,854,932 | 12/1974 | Bishop | 75/60 |
| 3,856,510 | 12/1974 | Nilles | 75/60 |

*Primary Examiner*—P. D. Rosenberg
*Attorney, Agent, or Firm*—Charles E. Baxley

[57] ABSTRACT

This disclosure teaches a method for recovering reaction gases from a hydrocarbon-cooled converter which is bottom blown by oxygen. The converter comprises a vessel which is tippable between an upright position and an inclined position. The vessel is provided with bottom tuyeres and a cleaning system for the reaction gases. The method is characterized by the fact that, on tipping of the vessel, nitrogen is introduced instead of the oxygen through the bottom tuyeres whereby flushing of the cleaning system is effected. Detection means (preferably a gas analyzer) are provided to detect a predetermined increase in hydrogen content of the reaction gases during blowing and a setting ring is connectable to the vessel in sealed engagement with a suction line which forms part of the cleaning system. Control means are responsive to the detection means and are operable to connect the setting ring to the vessel and for tipping the vessel so as to flush the cleansing system. The setting ring has a labyrinth seal which permits entrance of a minor portion of air but assures a vacuum of −5 to −15 mm during the blowing.

2 Claims, 6 Drawing Figures

QUANTITY OF OFF GAS PER TON OF PIG IRON AND
COMPOSITION OF OFF GAS AT CONVERTER MOUTH

QUANTITY OF OFF GAS PER TON OF PIG IRON AND COMPOSITION OF OFF GAS AT CONVERTER MOUTH

QUANTITY OF OFF GAS PER TON OF PIG IRON AND COMPOSITION OF OFF GAS AT CONVERTER MOUTH

METHOD FOR RECOVERING REACTION GASES FROM STEEL CONVERTERS WHICH ARE BOTTOM BLOWN WITH OXYGEN AND COOLED WITH HYDROCARBONS

BACKGROUND OF THE INVENTION

The present invention lies in the field of oxygen bottom blown steel converters, into the cooling jacket of which hydrocarbons are introduced which decompose during the blowing time with the formation of hydrogen.

While in this manner of operation, which is known as the OBM process, the hydrocarbons are fed uniformly distributed over the duration of the blowing time, it has been found that formation of CO gas commences only after a definite period of reaction and decreases towards the end of the blowing period.

The percentage of hydrogen is relatively high, particularly at the start and at the end of each blowing period proper. In FIG. 1 the variation of this percentage of gas over the blowing time is shown by way of example.

Here is where the present invention sets in. It solves the problem of providing a process and an automatic apparatus particularly suitable for carrying out thereof in order to recover the reaction gases in converters of this type, particularly as they are acquiring increasing economic importance. By recovery there is understood here in a broad sense the collecting of those gases, including their fine scrubbing and utilization.

STATEMENT OF INVENTION

The new process for the recovery of reaction gases from converters which are bottom blown with pure oxygen and cooled with hydrocarbons is a process in which the converters are flushed with nitrogen prior to the blowing period and controlled by the swinging motion of the converter until they are switched to the blowing in of oxygen and hydrocarbons, and then are blown with a vacuum of −5 to −15 mm (corresponding to the feeding of a quantity of combustion air of $n = 0.1$), while maintaining the watergas equilibrium, and towards the end of the blowing a gradual transition to complete combustion is effected at $n = 0.2$ to 0.3 (corresponding to a heat of emergence of 1000° C upon the emergence of the gas from the cooler).

One improvement in this process consists therein that by a control, upon a sudden rise of the $H_2$ content in the reaction gas during the main phase of the blowing time, a setting ring, which connects the converter with the suction line, is immediately lifted and the converter is automatically tipped, and nitrogen flows as a flushing agent through bottom tuyeres.

There is also advantageously a control device in which, during the preliminary, intermediate and subsequent short complete combustion periods, a setting ring which is controlled in height by a gas analyzer automatically closes the connection between the converter and the suction line for the collecting of the reaction gases after combustion of the $H_2$ portions and disappearance of the $O_2$ excess in the flue gas.

A setting ring with a labyrinth packing, which permits a slight admission of air at the connecting place but assures a vacuum of −5 to −15 mm during the main phase of the blowing time, has proven suitable for the carrying out of the process.

BRIEF DESCRIPTION OF DRAWINGS

The accompanying drawing will serve to facilitate understanding of the invention. In the drawing.

DESCRIPTION OF PREFERRED EMBODIMENT

Figure 1:
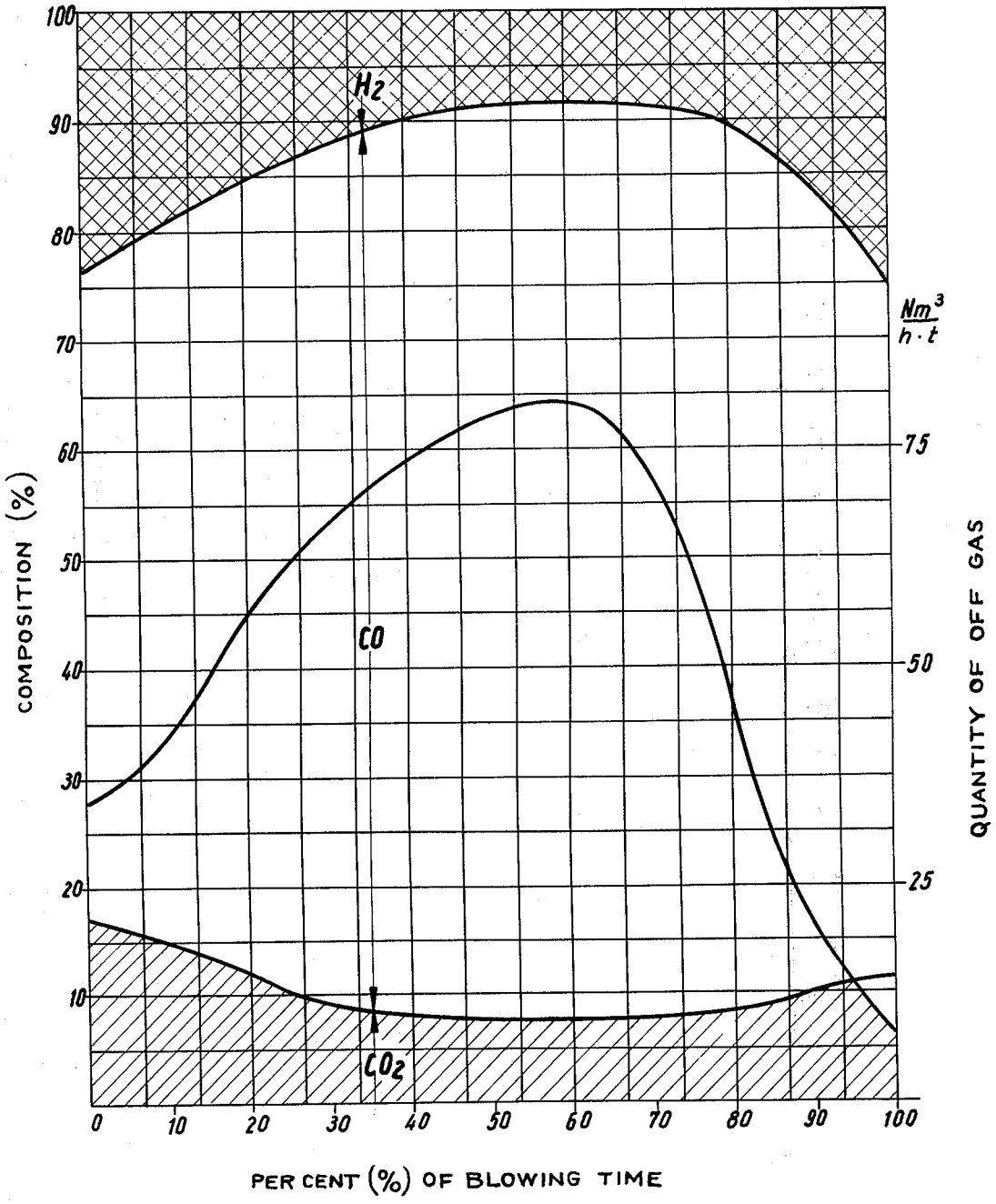
FIG. 1 (as already mentioned) indicates the quantity of off gas per ton of pig iron and the composition of the off gas at the mouth of the converter in percent during the blowing time, to which the new process relates.

The process of the invention takes place in the following manner:

1. First Step: "Inertia-izing Zone"

At the very start of the actual bath reactions, an introduction of flushing air through the bottom tuyeres during the charging of the crucible until the swinging thereof into the vertical blowing position is necessary and customary in all bottom blown converters. For this purpose, in accordance with the invention, a stream of inert gas (preferably $N_2$ ) may suitably be used, whereby the entire apparatus is briefly flushed in advantageous manner for the following cooling and cleaning of the reaction gases. In this way at the same time clogging of the tuyeres is prevented. This introduction of $N_2$ is, in accordance with the invention, automatically coupled with the mechanical swinging of the crucible.

For this purpose, for example, a collecting space below the bottom of the converter vessel can be connected via tuyeres in this bottom with the inside of the converter vessel and to a feedline for combustion gases, in which feedline a control valve is provided which, as a function of the inclination of the converter vessel, automatically opens and closes the feeding of the oxygen; in the same manner, control valves are arranged in each individual gas line for hydrocarbons and nitrogen.

During the actual steel refining, in contradistinction to the known top blow process, the oxygen through the bottom tuyeres, jointly with the hydrocarbons introduced through the cooling gas jacket, passes practically instantaneously into reaction with the hot metal bath, namely at the moment of the change of the flow of gas from $N_2$ to $O_2$ + cracked gas.

With the setting ring raised, full combustion of these primary reaction gases within the first phase with correspondingly higher suction of combustion air must first of all take place. By means of the relatively rapidly decreasing $O_2$ content (see FIG. 2), there first of all takes place the combustion of the $H_2$ portions which takes place, so to say, instantaneously as a result of the higher speed of ignition as compared with the CO; on basis of the $O_2$ analysis or the disappearance of the $O_2$ excess, the setting ring is automatically lowered.

Since the quantity of hydrocarbon used for the cooling of the bottom tuyeres must remain constant during all phases of the refining process, the $H_2$ fraction appears higher at the start and with the declining decomposition of C than in the so called blast peak.

2. Main Step of the Refining Process

With the lowering of the setting ring there takes place simultaneously the switching to a so called "controlled suction", in which connection only an extremely small amount of combustion air is admitted corresponding to $n = 0.1$ (maximum $n = 0.3$).

For this there has proven satisfactory a further development of a vertically adjustable water cooled hood or setting ring which is arranged between the upper edge of the crucible and the gas collector of oxygen converters. It has the special feature that a hood having the free outlet cross section of the converter is developed with a setting ring for gas tight placing thereof on the mouth of the converter and a circumferential air slot is arranged between the setting ring and the hood. This air slot is a labyrinth. This development will be explained in more detail below with reference to FIG. 6.

Such a setting ring on the one hand assures complete closure from the outside, i.e., a direct setting of the setting ring on the converter mouth, but by means of a labyrinth connection permits penetration of larger quantitites of air and at the same time maintaining of a vacuum of −5 to −15 mm water column within the suction hood, while on the other hand the emergence of the toxic reaction gases into the atmosphere is prevented even in case of strong variations in pressure.

With this manner of operation, during the actual blowing phase, the reaction-gas components after partial combustion in the absence of $O_2$ enter the watergas equilibrium:

$$CO + H_2O + CO_2 - H_2$$

Figure 2:
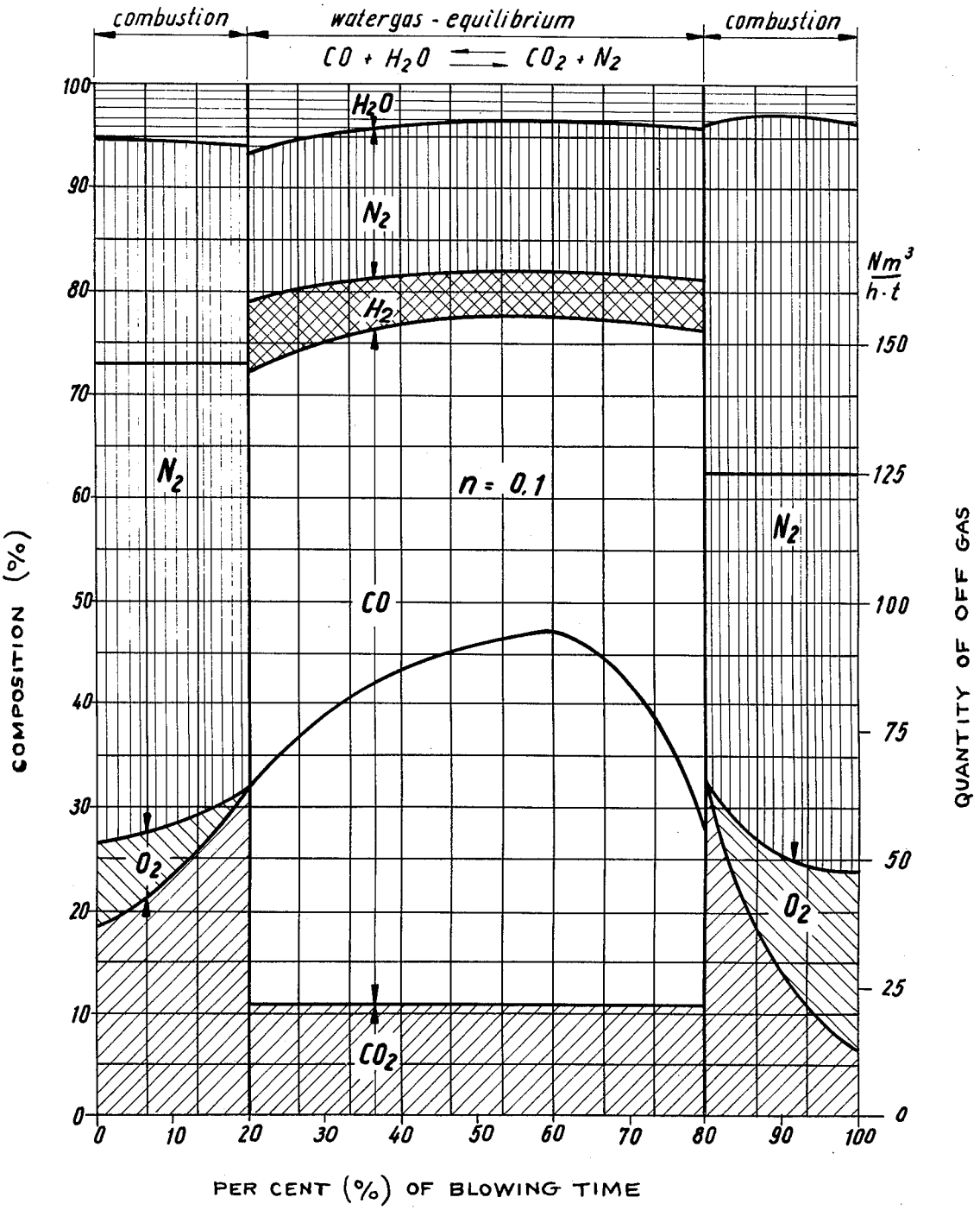
FIG. 2 shows the different composition of the operating gases upon bottom oxygen blowing with feed of nitrogen in accordance with the invention, with particular emphasis of the watergas equilibrium with a quantity of combustion air of $n = 0.1$.
Figure 3:
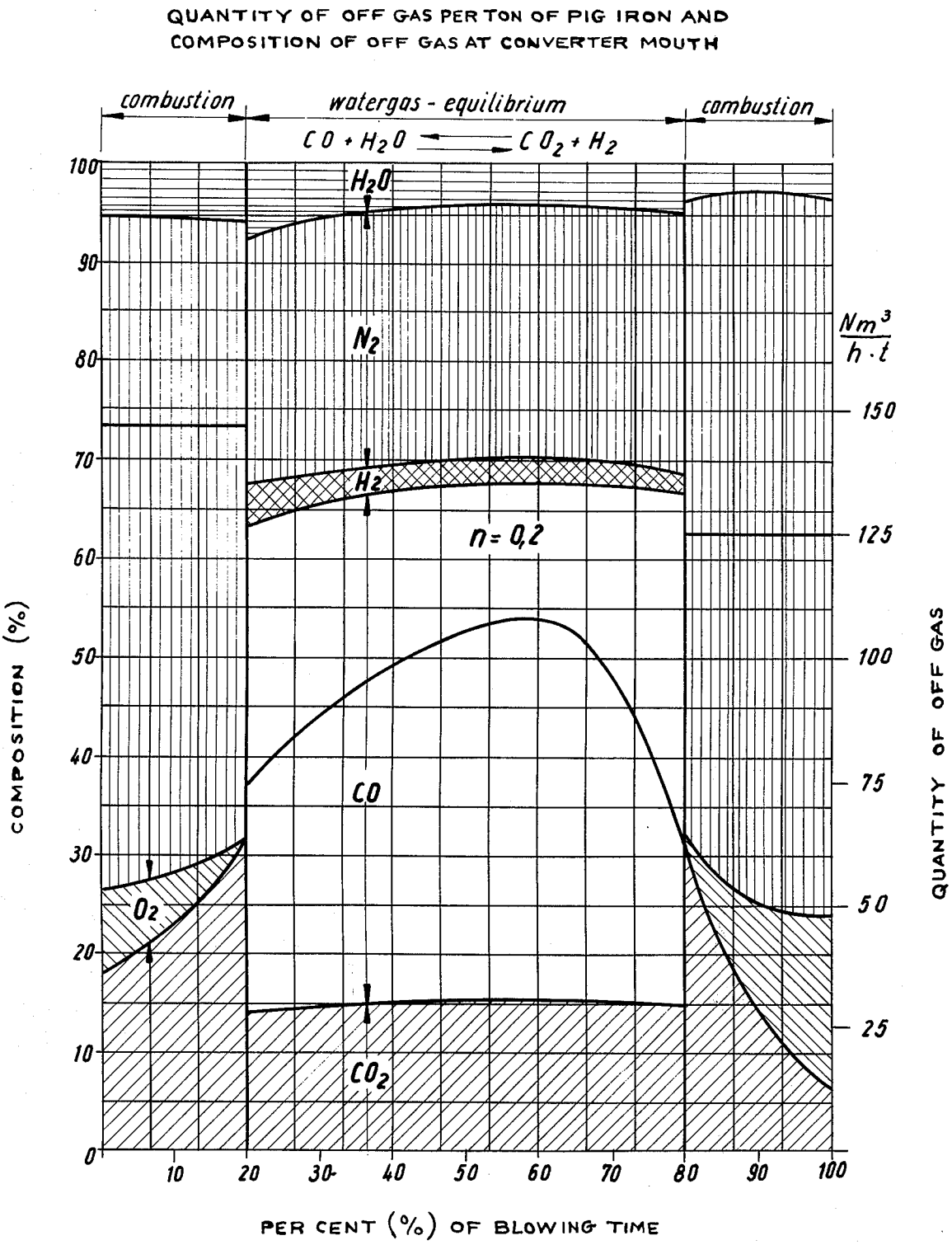
FIG. 3 corresponds to FIG. 2 for a quantity of combustion air of $n = 0.2$.
Figure 4:
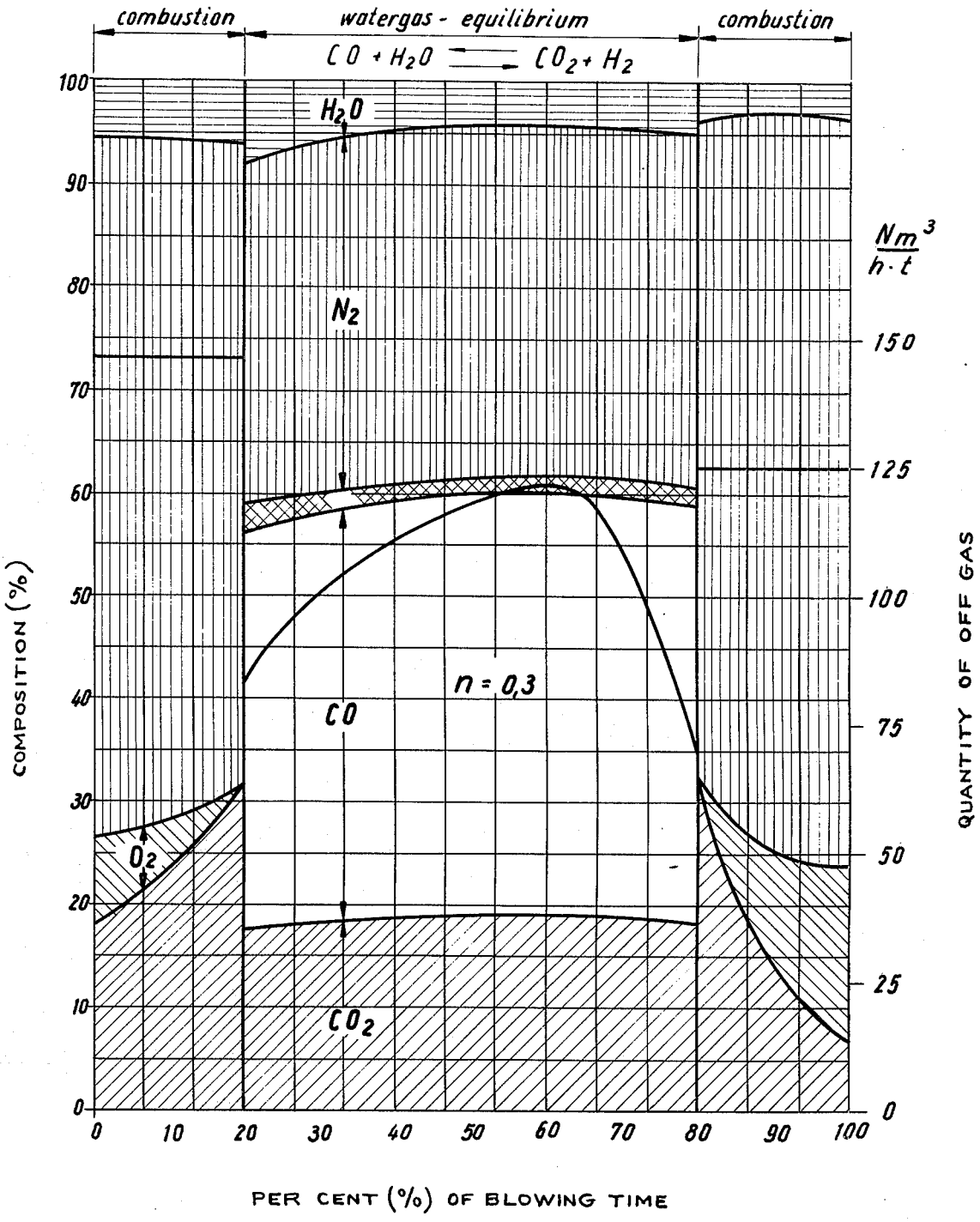
FIG. 4 for $n = 0.3$.

(see in this connection FIGS. 2 to 4).

$H_2$ containing gases are particularly dangerous due to their tendency to explode easily.

The $H_2$ content is in this connection between about 2 and 4%. It must be continuously registered and recorded because, with an increase above the corresponding percentage of $H_2$, an alarm is automatically given off and the crucible is swung out (under the aforementioned automatic introduction of $N_2$ as flushing gas). Upon being swung back again into the blowing position, the same applies.

3. Process Step

After the expiration of about 80% of the blowing period and the decrease of the quantity of CO gas and further increase of $H_2$ in the purified reaction volume, there again takes place, as under 1, a raising of the setting ring and the transition to full combustion. The reactions taking place in the three variants $n = 0.1$, 0.2 and 0.3 during the main blowing phase are shown in the corresponding FIGS. 2 to 4.

Figure 5:
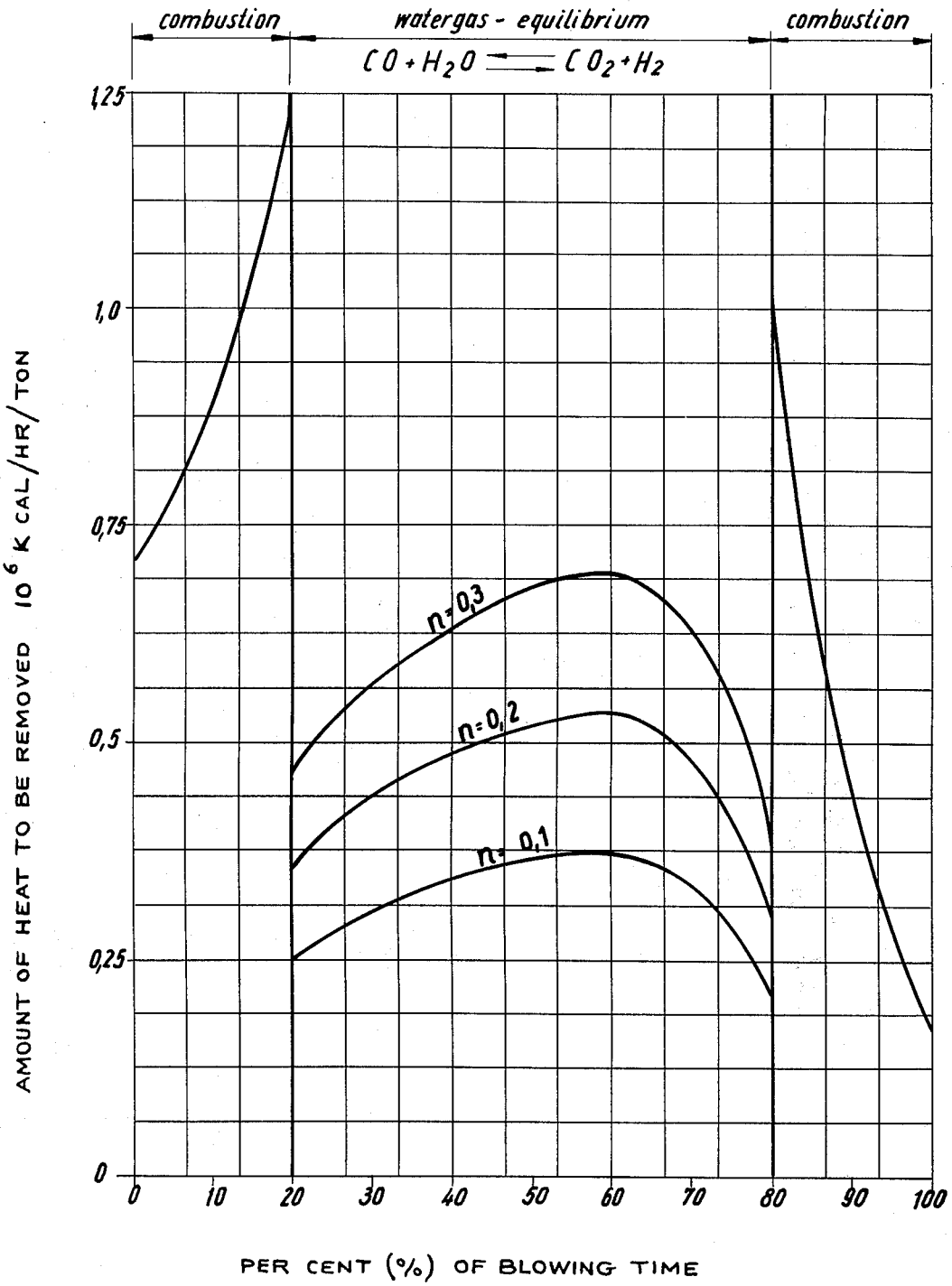
FIG. 5 shows the amount of heat to be withdrawn, referred to 1 ton of pig iron, and a gas outlet temperature of 1000° C, again related to the showing of the watergas equilibrium.

The curves plotted apply for a gas outlet temperature from the gas cooler of, on the average 1000° C, the cooler being so designed (see FIG. 5) that the normal heat load amounts with a partial combustion of $n = 0.3$. In the inertia-izing zones in which complete combustion takes place, it is thus also exceeded only for a short time and by not too much.

During all three phases, the resultant gases are carefully cleaned by wet scrubbing after cooling, the flue gases being discharged in the initial and final phase into the atmosphere, while the reaction gases of the main blowing period are burned off or used to advantage.

Figure 6:
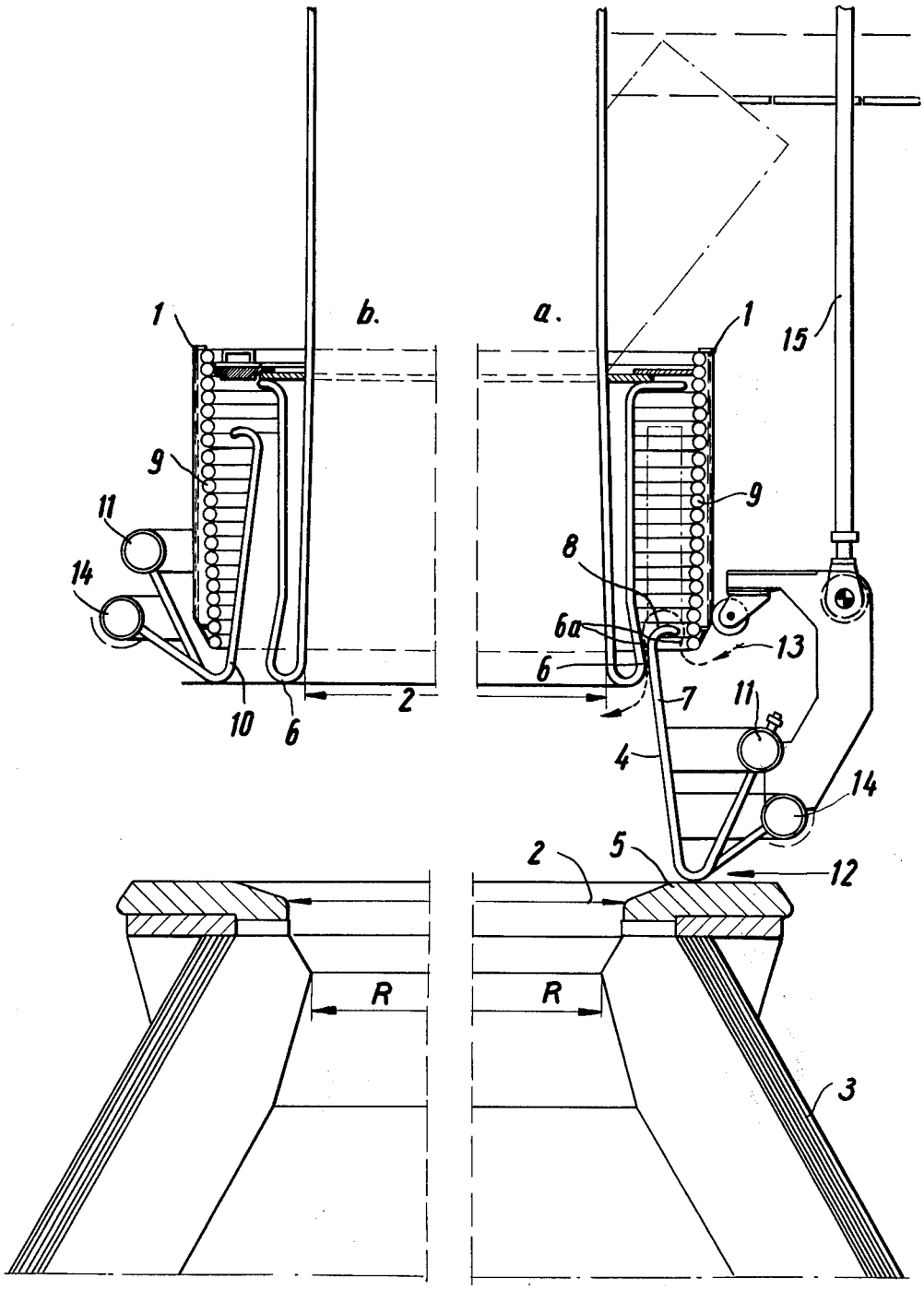
FIG. 6 shows a setting ring in accordance with the invention controlled in height by a gas analyzer.

FIG. 6 shows at *a* a central vertical partial section through a hood ring, which has proven suitable for practical embodiment of the invention, in operating position on the converter mouth and, in the lefthand part of the figure (6*b*), a partial section which constitutes a mirror image thereof and which shows the ring of the hood in open position. This ring in accordance with FIGS. 6*a* and *b* is developed in detail as follows and therefore has the manner of operation which will be explained thereafter.

Between the upper edge of the crucible in the gas collector of an oxygen converter, a hood 1 of the free cross section 2 of the converter 3 is developed with a setting ring 4 for hermetic placing on the converter mouth 5, as indicated by the arrow 12 in FIG. 6*a*. Between the setting ring 4 and the hood 1, there is arranged a circumferential air slot 6 the course of which is indicated by the dotted line arrow 13 in FIG. 6*a*. In FIG. 6 it is further clear that these air slots 6 are labyrinth paths 6*a*. The setting ring 4 is developed of cooling pipes 7. The latter have intermediate spaces at their upper curves 8. The cooling pipes 7 are served by cooling water lines 11, 14. The line 11 may for instance, be a cooling water inlet and the line 14 a cooling water outlet. The lifting and lowering device 15 for the setting ring is conventional and therefore does not require any description.

In FIGS. 6*a* and 6*b* it is further clear that the cooling pipes 7 for the setting ring 4 have a different inclination. The pipe nests 9 on the gas outlet side are arranged with an inclination of about 10° to the perpendicular, and the pipe nests 10 of the setting ring 4 with an inclination of about 7° to the perpendicular. This difference in inclination can be clearly noted from the figure. As shown by experience, in the closed position of the hood ring of FIG. 6, only a readily controllable vacuum of 15 mm water column through the labyrinth 6*a* of the air slot 6 is to be overcome.

The new arrangement of the air slot 6 between the nests of cooling pipes 7 and 9 is very advantageous, in particular due to the increased eddying of the air resulting from the labyrinth guidance 6*a* and therefore the heat transfer. The air slot therefore in the new invention is shifted from the horizontal seal to the vertical seal. In accordance with the invention, this minimum air admission is established at about 10% of the theoretical combustion air. The setting ring as such, is in this connection completely closed on the outside, i.e. it can be placed on the mouth of the converter, while the small percentage of partial combustion air necessary for the control enters through a sort of labyrinth closure via a lateral circumferential slot arranged in the vertical between the setting ring and the gas collection hood.

With this adjustment, a vacuum of −15 mm water column is then present automatically within the gas hood, which for all practical purposes assures discharge free operation at this important connecting place. Furthermore, upon operation in accordance with this invention, a seal; for instance by a water cup, an immersion seal or some other seal; can be dispensed with. As is known, they bring about considerable operating disadvantages at this place as result on the one hand of the prevailing high temperatures and on the other hand of the endangering of the operation upon the entrance of water into the molten metal, and finally due to the danger of the depositing of dust as well as the continuous cleaning necessary.

One particular advantage of the new setting ring with respect to the arrangement of a vertical air slot resides furthermore in the fact that as a result of the continuous operation upon the lifting and lowering of the setting ring, there is in this way obtained the best assurance for continuous mechanical automatic removal of any deposits of slag. Any deposits can automatically drop out both upon the raising and upon the lowering.

In this connection it is also of particular importance that the inclination of the pipe bends is advisedly about 10° on the gas discharge side, while the inclination of the actual setting ring is about 7° to the vertical.

Finally, one advantage of the new setting ring in accordance with the invention is that the setting ring proper can be raised or lowered automatically at any time as desired, for instance in case of any possible disturbances in the blowing operation (occurrence of foam slag), or if a higher degree of partial combustion should be desired for any given reasons.

The lifting and lowering movement of the setting ring, as well as the swinging movement of the converter vessel, but independently of it, can be controlled automatically in known manner. In accordance with the invention, the reading of ordinary gas analyzers serves for this purpose.

It will be apparent to these skilled in steel production that wide deviations may be made from the shown embodiment without departing from a main theme of invention set forth in claims which follow.

I claim:

1. In a method for recovering reaction gases from a hydrocarbon cooled steel converter which is bottom blown by oxygen; with the converter comprising a vessel tippable between an upright position and an inclined position, the vessel provided with bottom tuyeres, the vessel having a mouth and provided with a setting ring detachably connectable to the vessel in substantially sealed engagement about the mouth, the setting ring also in substantially sealed engagement with a suction line which communicates in flow series with gas cleaning means; a method for handling excess hydrogen buildups in the converter and characterized by steps as follows:

Step a. detecting by means of a gas analyzer a predetermined buildup in hydrogen content of the reaction gases during the blowing with oxygen, Step b. on the detecting of the hydrogen buildup per Step a preceding, causing the gas analyzer to effect the connection of the setting ring to the vessel, Step c. on the detecting of the hydrogen buildup per Step a preceding, causing the converter to be automatically tipped to operate valves for shutting off the oxygen and bottom blowing the vessel with an inert gas for flushing of the cleaning means to provide a barrier of the inert gas between atmospheric air and combustiles in the gas cleaning means.

2. The method of claim 1 further characterized by providing nitrogen as the inert gas.

* * * * *